United States Patent [19]

Kan et al.

[11] Patent Number: 4,583,490

[45] Date of Patent: Apr. 22, 1986

[54] THIN DEVELOPER LAYER FORMING APPARATUS

[75] Inventors: Fumitaka Kan, Yokohama; Hatsuo Tajima, Matsudo; Atsushi Hosoi, Tokyo; Masanori Takenouchi, Urawa; Takashi Saito, Ichikawa, all of Japan

[73] Assignee: Canon Kabushiki Kaisha, Tokyo, Japan

[21] Appl. No.: 638,786

[22] Filed: Aug. 8, 1984

[30] Foreign Application Priority Data

Aug. 18, 1983 [JP] Japan ..... 58-151028
Oct. 31, 1983 [JP] Japan ..... 58-205187

[51] Int. Cl.[4] ..... G03G 15/09
[52] U.S. Cl. ..... 118/658
[58] Field of Search ..... 118/658

[56] References Cited

U.S. PATENT DOCUMENTS 4,244,322 1/1981 Nomura, et al. ..... 118/658
4,406,535 9/1983 Sakamoto, et al. ..... 355/3
4,425,373 1/1984 Hosono et al. ..... 118/658
4,468,111 8/1984 Yamagata et al. ..... 118/658 X

*Primary Examiner*—Bernard D. Pianalto
*Attorney, Agent, or Firm*—Fitzpatrick, Cella, Harper & Scinto

[57] ABSTRACT

A thin developer layer forming apparatus including a developer supply container, having an opening, for containing a developer and magnetic particles, an endlessly movable developer carrying member for carrying the developer, which is movable between an inside of the developer supply container and an outside of the developer supply container through the opening, a magnetic particle confining member, provided to an outer surface of the developer carrying member with a gap, and a magnet for generating a fixed magnetic field, having a magnetic pole disposed inside of the carrying member and upstream of the confining member with respect to movement of the developer carrying member, wherein the confining member is inclined toward downstream with respect to the movement of the developer carrying member to confine the magnetic particles within the developer supply container and to apply only the developer on the developer carrying member.

19 Claims, 11 Drawing Figures

THIN DEVELOPER LAYER FORMING APPARATUS

BACKGROUND OF THE INVENTION

The present invention relates to a thin developer layer forming apparatus wherein a thin layer of a dry developer is formed on a developer carrying member, which layer is used to developer a latent image.

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent demand for the improved sharpness, resolution or the other qualities has necessiated the achievement of the system for forming a thin layer of one-component dry developer.

A method of forming a thin layer of one-component dry developer has been proposed in U.S. Pat. Nos. 4,386,577 and 4,387,664 and this has been put into practice. However, this is the formation of a thin layer of a magnetic developer, not of a nonmagnetic developer. The particles of a magnetic developer must each contain a magnetic material to gain a magnetic nature. This is disadvantageous since it results in poor image fixing when the developed image is fixed on a transfer material, also in poor reproducibility of color (because of the magnetic material, which is usually black, contained in the developer particle).

Therefore, there has been proposed a method wherein the developer is applied by cylindrical soft brush made of, for example, beaver fur, or a method wherein the developer is applied by a doctor blade to a developer roller having a textile surface, such as a velvet, as to a formation of non-magnetic developer thin layer. In the case where the textile brush is used with a resilient material blade, it would be possible to regulate the amount of the developer applied, but the applied toner layer is not uniform in thickness. Moreover, the blade only rubs the brush so that the developer particles are not electrically charged, resulting in foggy images.

A new thin developer layer forming method which is completely different from conventional ones has been proposed in, for example, U.S. Ser. Nos. 466,574 and 601,715, which have been assigned to the assignee of the present application. In this method, a magnetic particle confining member is provided to oppose a developer carrying member, and a magnetic brush of magnetic particles are formed by a magnetic force provided by magnetic field generating means, at a position upstream of the magnetic particle confining member with respect to the movement of the developer carrying member, whereby a thin layer of non-magnetic developer particles is formed by the magnetic brush which is constrained by the magnetic particle confining member. However, it is difficult in this method to completely constrain the magnetic particles within the developer container by the magnetic particle confining member. The magnetic particles, although the amount is very small, can leak and reach the developing station. Those leaked magnetic particles can damage the latent image bearing member or cause electrical leakage between the latent image bearing member and the developer carrying member. This results in a non-uniform developed image or unclear image.

SUMMARY OF THE INVENTION

Accordingly, it is a principal object of the present invention to provide a thin developer layer forming apparatus wherein the leakage of the magnetic particles is effectively prevented at the magnetic particle confining member, so that the thin layer of the developer is stably formed on the surface of the developer carrying member for a long period of time.

It is another object of the present invention to provide a thin developer layer forming apparatus wherein a better confinement of the magnetic particles and stable and uniform formation of a thin layer of non-magnetic developer are assured with a simple structure, and the developer and magnetic particles are prevented from leaking at the ends of a developing apparatus.

It is a further object of the present invention to provide a thin developer layer forming apparatus wherein a thin layer of non-magnetic developer is formed which has better color reproducibility suitable for color development.

It is a yet further object of the present invention to provide a thin developer layer forming apparatus wherein a thin layer of non-magnetic developer with improved fixing properties is formed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will now be described in conjunction with the accompanying drawings.

Figure 1:
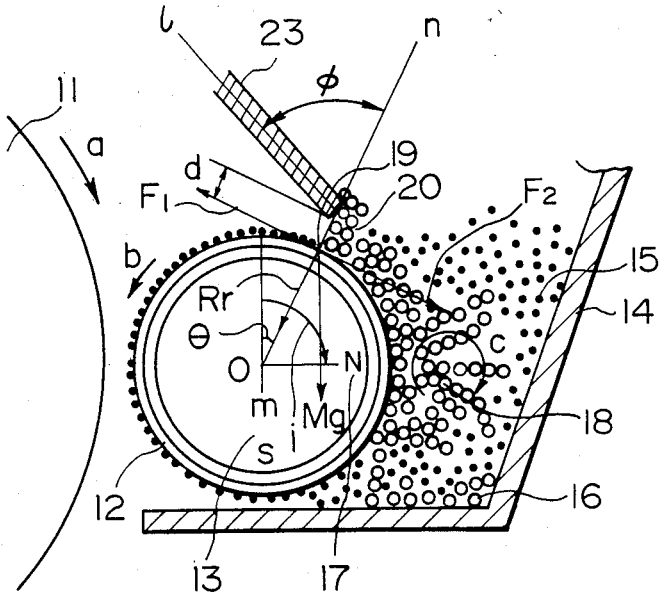
FIG. 1 is a cross-sectional view of a thin developer layer forming apparatus according to an embodiment of the present invention.

Referring to FIG. 1, there is shown fundamental structures of the thin developer layer forming apparatus according to an embodiment of the present invention. A cylindrical electrophotographic photosensitive member 11 for bearing a latent image to be developed is rotatable in the direction of an arrow a. To this photosensitive member 11, a non-magnetic sleeve 12, which is the developer carrying member is provided with a gap. The sleeve 12 rotates in the direction of an arrow b together with rotation of the photosensitive member 11. Within the sleeve 12, a fixed magnet 13, which is the magnetic field generating means, is provided. A hopper 14, which is the developer supply container, accommodates the sleeve 12 and contains a developer mixture comprising non-magnetic developer particles 15 and magnetic particles 16.

The magnet 13 has a magnetic pole 17. In the neighbourhood of the sleeve 12 surface adjacent to the magnetic pole 17, a magnetic brush of the magnetic particles 16 is formed. When the sleeve 12 is rotated in the direction of arrow b, the magnetic brush circulates in the direction of an arrow c in the neighbourhood of the magnetic pole 17, thus forming a circulating layer 18, if the magnetic pole 17 is properly disposed and if the flowability and the magnetic characteristics of the magnetic particles 16 are properly selected.

To a position 19 on the surface of the sleeve 12 downstream of the magnetic pole 17 with respect to the rotation of the sleeve 12, a magnetic blade 23 of a magnetic material, which is the magnetic particle confining member, is opposed with a clearance d. The center line 1 of the magnetic blade 23 is inclined at an angle $\phi$ with respect to the line n normal to the surface of the sleeve 12 and passing through the point 19, toward the downstream with respect to the movement of the sleeve surface, as shown in FIG. 1. The magnetic particles 16 are constrained or confined at the point 19 on the surface of the of the sleeve 12 because balance between the confining force by the gravity, magnetic force and the confinement due to the existence of the magnetic blade 23 and the conveying force in the direction of the movement of the sleeve 12, so that they form a stationary layer 20 which is slightly movable but substantially immovable. Thus, a magnetic particle layer comprising the circulating layer 18 and the stationary layer 20 is formed on the surface of the sleeve 12. The magnetic particle layer contains non-magnetic developer 15 among the magnetic particles 16. The magnetic particles 16 in the stationary layer 20 is confined on the surface of the sleeve 12 because of the above-mentioned balance between the confining force and the conveying force. However, the developer, which is non-magnetic, is free from the magnetic field of the magnetic pole 17, and uniformly applied on the surface of the sleeve 12 as a thin layer by an image force. The thin layer of the developer is conveyed by the rotation of the sleeve 12 and comes to be opposed to the surface of the photosensitive member 11 to develop an image thereon.

In the circulating layer 18, the magnetic brush circulates in the direction shown by the arrow c because of gravity, magnetic force by the magnetic pole, a friction force and the flowability (viscosity) of the magnetic particles 16. During the circulation thereof, the magnetic brush takes thereinto the nonmagnetic developer 15 from a developer layer above the magnetic particle layer and return to the bottom of the developer supply container 14. This circulation is repeated. The magnetic blade 23 is not directly concerned with this circulation.

The conditions for confining the magnetic particles will be explained in detail. The conveying force F1 and the confining force F2 are, $$F1=f(Rr+Mg\cos\theta) \tag{1}$$

$$F2=R\theta+Mg\sin\theta+B \tag{2}$$

where

Rr: a magnetic force by the magnetic pole 17 in the direction normal to the surface of the sleeve 12 at the point 19 thereon, R$\theta$: the magnetic force in the tangential direction at the same point, f: a coefficient of friction, M: a mass of the magnetic particles in the stationary layer 20, $\theta$: an angle between the normal line n and a vertical line m passing through the center 0 of the sleeve 12, g: acceleration of gravity, and B: confining force resulting from the existence of the magnetic blade 23.

The necessary condition for the confinement is, $$F=F2-F1\geqq 0 \tag{3}$$

The mass of the stationary layer 20 is $$M=\rho ct \tag{4}$$

where $\rho$: the density of the stationary layer 20, c: volume packing density, and t: thickness of the stationary layer 20.

Since the confining force provided by the magnetic blade 23 is dependent on the clearance between the sleeve 12 and the magnetic blade 23 and the angle $\phi$ formed between the normal line n and the center line 1 of the magnetic blade 23, the confining force B thereof is $$B=B(d,\phi,\theta) \tag{5}$$

From equations (1), (2), (3), (4) and (5), $$F(\theta)=\rho ctg\sqrt{1+f^2}\sin(\theta-\mathrm{Tan}^{-1}f)+R\theta(\theta)-Rr(\theta)+B(d,\phi,\theta) \tag{6}$$

As indicated by the inequality (3), $F(\theta)\geqq 0$ is the necessary condition for the confinement of the magnetic particles.

In view of the equation (6), if $$R\theta(\theta)\geqq Rr(\theta) \tag{7}$$

$$\theta\geqq \mathrm{Tan}^{-1}f \tag{8}$$

are satisfied, the condition for the confinement is satisfied if the magnetic force and the friction force are considered separately. If the above conditions are satisfied, the magnetic particles are confined without the magnetic blade 23. Since $\vec{R}=(Rr, R\theta, Rz)$ and $\vec{H}=(Hr, H\theta, Hz)$, the equation $\vec{R}=\mathrm{grad}(\vec{M}\cdot\vec{H})$, and therefore, the equation $\vec{M}=x\vec{H}$ (x is magnetic susceptibility). Therefore, the inequality (7) gives $$H\theta(\theta)\geqq Hr(\theta) \tag{9}$$

where $Hr(\theta)$: the component, in the direction of the normal line, of the magnetic flux density distribution on the surface of the sleeve 12 when there is no magnetic particles, and $H\theta(\theta)$: the component, in the tangential direction, of the same.

That is, the inequality (7) is satisfied when the angle $\theta$ satisfies the inequality (9). If, for example, the magnetic flux density distribution of the magnetic pole 17 is in the form of a sine wave, the inequality (7) is satisfied, if $$Hr(\theta) \leqq Hp/\sqrt{2} \tag{10}$$

where

Hp is the maximum strength of the magnetic pole 17 (the component in the direction of the normal line at the position of the magnetic pole 17).

Figure 2:
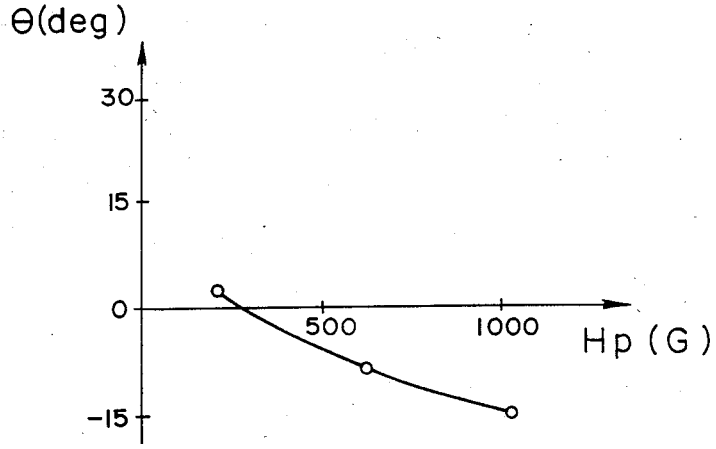
FIG. 2 is a graph showing the relationship between the strength of the magnetic field and the confinement of the magnetic particles.

FIG. 2 shows the range of the angle $\theta$, within which the magnetic particles 16 are confined, in relation to the maximum strength Hp of the magnetic pole 17, when the apparatus is constructed as shown in FIG. 1 with the following conditions:

The magnetic blade 23: a steel plate of 1.5 mm thickness, angle $\phi$: 90 degrees (tangential direction of the surface of the sleeve 12), and the clearance d: 0.3 mm.

In FIG. 2, the angle $\theta$ is positive in the clockwise direction from the vertical line m. It is particularly noted here that the confinement is possible even when $\theta$ is smaller than 0, and that the confinement is better as the strength of the magnetic pole 17 increases. This is because, as the effect B (d, $\phi$, $\theta$) of the magnetic blade 23 in the equation (5), the magnetic blade 23 is effective to strengthen the magnetic field $H\theta$ in the tangential direction at the point 19 which is the intersection between the normal line n and the surface of the sleeve 12. Therefore, the magnetic blade 23 is preferably extended substantially along the magnetic field $\vec{H}$ in order to make easier the formation of the magnetic circuit. As the position thereof represented by the angle $\theta$ is preferably, although not absolutely necessary, in agreement with the inequality (9).

At the limit of the inequality (9), that is, when the equation $$H\theta(\theta)=Hr(\theta) \tag{11}$$

is satisfied, the tangential component $H\theta$ and the normal component Hr of the magnetic field on the sleeve 12 are equal, so that the direction of the magnetic field vector is inclined at an angle 45 degrees with respect to the direction of the normal line n. Assuming that the condition defined by the equation (11) is satisfied at the point 19 in FIG. 1, the inclination $\phi$ of the magnetic blade 23 is preferably about 45 degrees or slightly larger.

Figure 3:
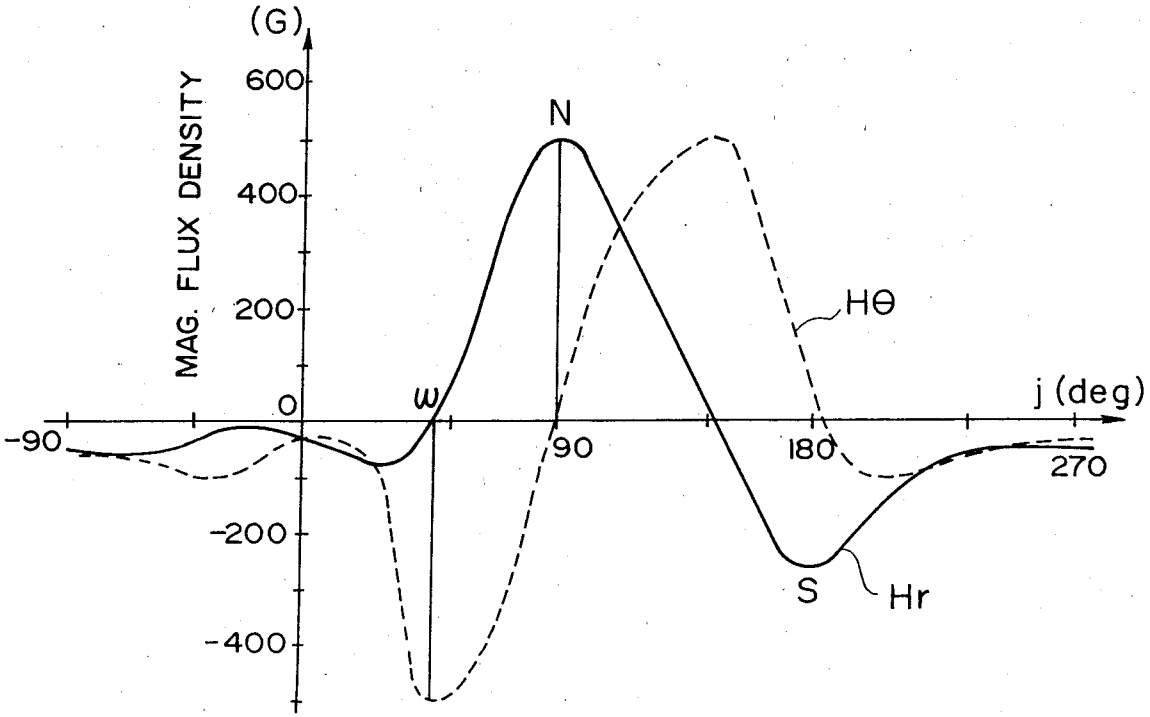
FIG. 3 is a graph showing a magnetic force distribution.

FIG. 3 shows the normal component Hr (solid line) and the tangential component $H\theta$ (broken line) of the magnetic flux density distribution of the magnet 13, which have been measured by a 620-type Gauss meter (available from Bell). The reference position, 0 degree, corresponds to the vertical line m, and the angle j (degrees) is measured in the clockwise direction. The flux density in the positive side is the strength of the N pole, while the flux density at the negative side shows the strength of the S pole. Generally, the direction of the vector of the magnetic field is usually defined by the magnetic field in the normal direction. Actually, however, as will be understood from FIG. 3, when the peak of the magnetic field in the normal direction is at the position of 90 degrees (N pole), the magnetic field in the tangential direction is 0 Gauss, while the peak of the magnetic field in the tangential direction is at the point w where the magnetic field in the normal direction is 0 Gauss.

Figure 4:
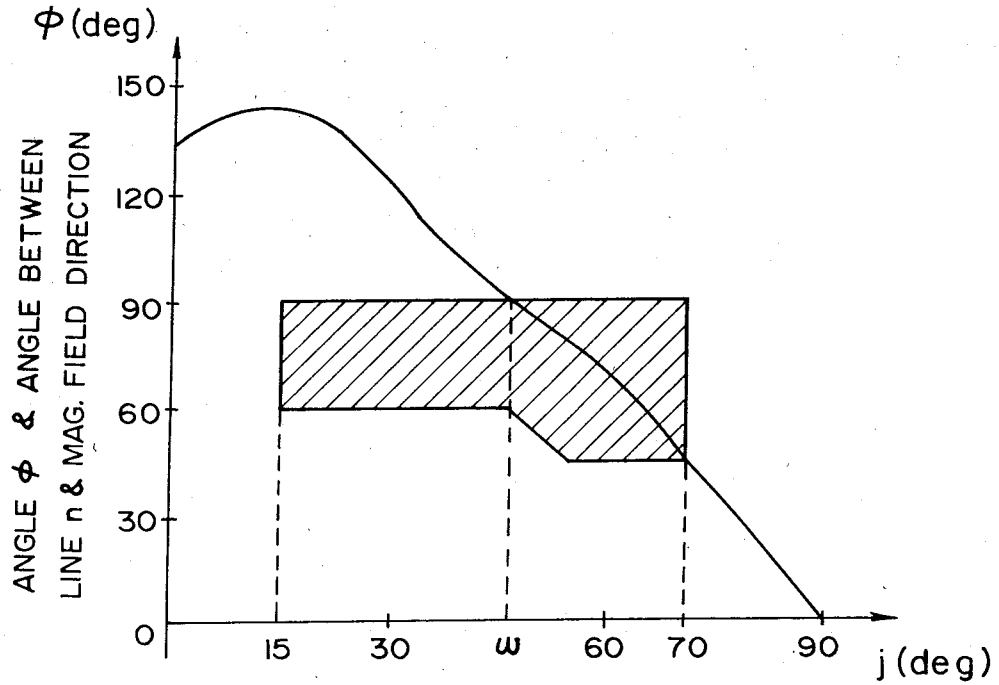
FIG. 4 illustrates the relation between the vector of the magnetic field and the direction of the magnetic blade.

FIG. 4 shows by the solid lines the angle formed between the direction of the magnetic field vector and the normal line n with respect to the angle j in the range thereof, j=0−90 degrees which is proper for the positioning of the magnetic blade 23, in the case of the magnet 13 of FIG. 1. The hatched range in this Figure is the range which showed particularly preferable magnetic particle confinement, when the blade angle $\phi$ with respect to the normal line n was changed under the condition that the position i of the N pole of the magnet 13 is 90 degrees. In the range of $j > 70$ degrees, wherein $|H\theta| < |Hr|$, the circulation of the magnetic particles are adversely affected.

It is understood from FIG. 4 that, when the angle j is not more than w, it is preferable that approx. 60 degrees$\leqq\phi\leqq$90 degrees; that when $w<j<$ 90 degrees, it is preferable that 45 degrees$\leqq\phi\leqq$90 degrees, (more preferably, 60 degrees$\leqq\phi\leqq$90 degrees) substantially in the direction of the magnetic field. These are the preferable conditions for the blade positioning. In order to strengthen the magnetic field $H\theta$ in the tangential direction, a larger angle of $\phi$ is preferable, that is, nearer to the horizontal. Preferably, the magnetic blade 23 is positioned in the direction of the magnetic field $H\theta$.

A conventional magnetic blade which are extended in the direction of the normal line n can abruptly stop the magnetic particles, so that the pressure in the neighbourhood of the magnetic blade is increased to deteriorate the developer. Because of the high pressure, the pressing force can extend to the clearance between the magnetic blade and the surface of the sleeve, with the result that a slight amount of the magnetic particles are leaked through the clearance.

According to this embodiment of the present invention, the tip end of the magnetic blade 23 is so positioned that $Hr<H\theta$ is satisfied, that is, the tangential component $H\theta$ of the sleeve surface magnetic flux of the magnetic pole is larger than that in the normal direction Hr. By doing so, the force in the tangential direction is predominant over the pressure in the normal direction, whereby the leakage of the magnetic particles and the deterioration of the developer are prevented, both of which are otherwise caused by the above mentioned pressure. Referring back to the conventional structure wherein the magnetic blade extends in the normal direction, a strong magnetic force is exerted to the magnetic particles in the normal direction, and therefore, Rr is large in the equation (1). This results in a larger friction force exerted to the magnetic particles, which leads to a larger conveying force. Therefore, it is easier for the magnetic particles to be leaked at the position of the magnetic blade. On the contrary thereto, according to the embodiment of the present invention, there is hardly any, or very small if any, magnetic force at the magnetic blade position in the normal direction, while on the other hand, the magnetic force in the tangential direction is strong, whereby the magnetic particles are more effectively confined.

The conditions for the magnetic particle circulation and the conditions for the magnetic particle confinement described above are significantly dependent on the position of the magnetic pole 17. Experiments have been made with respect to the confinement performance and the circulation performance without the magnetic blade 23 and the confinement performance with the magnetic blade 23 according to the embodiment of the present invention with the angle i being changed, wherein the angle i is the angle formed between the vertical line m and the magnetic pole 17 position. Table 1 shows the results, wherein "G" means a good confinement or circulation performance for the magnetic paricles, "F" means a fair performance, and "B" means that the magnetic particles are not sufficiently confined and conveyed out, or the circulation is insufficient.

As will be understood from Table 1, the range in which the stationary layer 20 of the magnetic particles is satisfactorily confined, and in which the magnetic brush in the circulation layer 18 is satisfactorily circulated to take thereinto the non-magnetic developer, is 60 degrees$<i<$120 degrees, preferably, 70 degrees$<i<$110 degrees. If, however, the magnetic blade 23 of the present invention is used, the confinement performance is enhanced, so that the range is broadened to 20 degrees$<i<$120 degrees, preferable 30 degrees$<i<$110 degrees.

Figure 5:
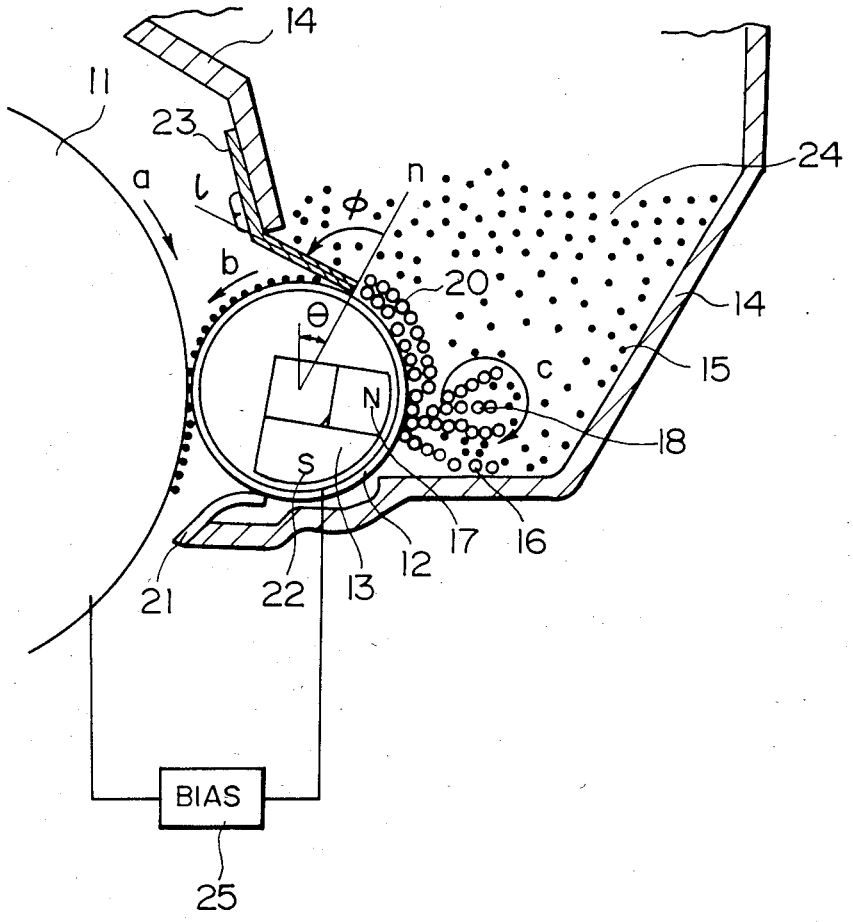
FIG. 5 is a cross-sectional view of a developing apparatus used with the thin developer layer forming apparatus according to the embodiment of the present invention.

FIG. 5 shows the thin developer layer forming apparatus embodying the concept explained with FIG. 1. The elements in FIG. 5 which correspond to the elements in FIG. 1 are assigned by the same reference numerals.

TABLE 1

| ANGLE i (DEGREES) | CONFINEMENT PERFORMANCE (NO BLADE) | CIRCULATION PERFORMANCE | CONFINEMENT PERFORMANCE (WITH BLADE) |
|---|---|---|---|
| 0 | B | G | B |
| 10 | B | G | B |
| 20 | B | G | F |
| 30 | B | G | G |
| 40 | B | G | G |
| 50 | B | G | G |
| 60 | F | G | G |
| 70 | G | G | G |
| 80 | G | G | G |
| 90 | G | G | G |
| 100 | G | G | G |
| 110 | G | G | G |
| 120 | G | F | G |
| 130 | G | B | G |
| 140 | G | B | G |

FIG. 5 illustrates a developer thin layer forming device or a developing apparatus, wherein the photosensitive member 11 rotates in the direction of arrow a. Opposed to the surface of the photosensitive member 11 with a gap, a non-magnetic member for carrying a developer, that is the sleeve 12, is provided. In this embodiment, the developer carrying member 12 is in the form of a cylinder, or more particularly, a sleeve, but it may be an endlessly movable web. This is the same with respect to the photosensitive member 11. With the rotation of the photosensitive member 11, the carrying member 12 is rotated in the direction of arrow b. A developer supply container 14 is provided to supply the developer to the carrying member 12. The container 14 is provided with an opening adjacent its lower part. The carrying member 12 is provided in the opening. Since the carrying member 12 is partly exposed outside, the surface thereof moves from the inside of the container 14 to the outside thereof and then back into the container 13. The bottom part of the container 14 is formed into an enclosure for enclosing the lower part of the developer carrying member 12 to prevent the leakage of the developer. To further ensure the prevention of leakage, a sealing member 21 is contacted to the carrying member 12.

Inside the carrying member 12, magnetic field generating means, i.e., a magnet 13 in this embodiment, is fixedly supported so that the carrying member 12 only rotates. The magnet 13 has N magnetic pole 17 and S pole 22.

In the neighbourhood of the upper part of the container 14 opening, a magnetic blade 23, as magnetic particle confining means, is provided to confine within the container 14 the magnetic particles 16. The magnetic blade 23 is manufactured by bending a steel plate and is secured to the container 14. The clearance d between the edge of the magnetic blade 23 and the surface of the developer carrying member 12 is 100–1000 microns, preferably, 200–500 microns. In this embodiment, it is 300 microns. If the clearance is smaller than 100 microns, the clearance may be clogged with magnetic particles 16, which are then undesirably pushed out. If, on the other hand, it is larger than 1000 microns, a large amount of the magnetic particles may leak through the clearance upon the possible occurence of vibration, and therefore, prevent the operation of thin layer formation.

Into the container 14 of the above-described structure, magnetic particles or a mixture of magnetic particles and non-magnetic developer particles is supplied so that a stationary layer 20 and a circulating layer 18 are formed. The mixture constituting the magnetic particle layer consisting of the stationary layer 20 and the circulating layer 18, preferably contains 2–70 wt. % of non-magnetic developer, but may only contain magnetic particles. The particle diameter of the magnetic particle is 30–200, preferably 70–150 microns. Each of the magnetic particles may consist of a magnetic material or may consist of a magnetic material and non-magnetic material. Further, it may be a mixture of two different kinds of magnetic particles.

The magnetic particles in the circulating layer 18 is formed into a magnetic brush by the magnetic field provided by the magnet 13, which brush is effective to perform a circulation in the direction shown by the arrow c. The stationary layer 20 formed between the magnetic pole 17 and the magnetic blade 23, is constrained on the surface of the developer carrying member 12.

Above the magnetic particle layer, nonmagnetic developer particles are supplied to form a developer layer 24, so that two layers are formed generally horizontally in the container 14, that is, the magnetic particle layer outside the developer carrying member and the developer layer outside the magnetic particle layer. The non-magnetic developer supplied may contain a small amount of magnetic particles, but even in that case, the magnetic particle content of the developer layer 17 is smaller than that of the magnetic particle layer. To the non-magnetic developer particles, silica particles for enhancing the flowability and/or abrasive particles for effectively abrading the surface of the photosensitive member 11 may be added.

The formation of the two layers is not limited to this manner, i.e., two materials are supplied separately, but may be made, for example, by supplying a uniform mixture of the magnetic particles and non-magnetic developer containing the sufficient amount of respective materials for the entire magnetic particle layer and developer layer 24, and then vibrating the container 14 or preliminarily rotating the developer carrying member 12 so as to form the two layers, using the magnetic field of the magnet 13 and the difference in the specific gravity between the two materials.

Supplying a substantially uniform mixture of the magnetic particles and non-magnetic developer particles instead of formation of the two layers, is practicable if the mixture contains an amount of magnetic particles to form the sufficient magnetic brush. However, for the purpose of long term stability of the magnetic brush, the formation of two layer is preferable.

After the magnetic particles and the nonmagnetic developer are supplied in the manner described above, the carrying member 12 is rotated. The magnetic particles are circulated by the magnetic field provided by the magnetic pole 17, gravity, the force of friction with the surface of the carrying member, as shown in FIG. 4 by arrow c. During this circulation, the non-magnetic developer particles contact the carrying member 12 surface so that the non-magnetic developer contained in the circulation layer 18 is coated on the carrying member 12 surface electrostatically.

In this embodiment of the present invention, the non-magnetic developer is triboelectrically charged by contact with the magnetic particles 16 and with the carrying member 12. Preferably, however, the triboelectric charge with the magnetic particles 16 is reduced by treating the surface of the magnetic particle 16 with an insulating material, such as oxide coating and a resin having the same electrostatic level as the non-magnetic developer, so that the necessary charging is effected by the contact with the carrying member 12 surface. Then, the deterioration of the magnetic particles is prevented, and simultaneously, the non-magnetic developer is stably coated on the carrying member 12.

On the other hand, the triboelectrically charged non-magnetic developer particles, which are non-magnetic, are not limited by the magnetic field existing in the clearance between the tip of the magnetic blade 23 and the surface of the carrying member 12, so that they are allowed to pass there, and they are coated as a thin layer of uniform thickness on the carrying member 12 by the image force. The thin layer of the non-magnetic developer is then conveyed out of the container 14, and moved to the developing station, where the thin layer is opposed to the photosensitive member 11 to develop a latent image thereon.

The developing system to be used here is preferably the non-contact type development disclosed in U.S. Pat. No. 4,395,476. However, a conventional contact type development is also usable. Between the photosensitive member 11 and the carrying member 12, a voltage is applied by a bias voltage source 25 which is of AC, DC or preferably an AC superposed with a DC. The developer to be consumed for the development is supplied from the circulation layer 18, and the consumption of the developer in the circulating layer 18 is compensated from the developer layer 24 during the above-described circulation.

Since, when the two layer structure is taken, the magnetic particle layer consisting of the circulating layer 18 and the stationary layer 20, is formed around the carrying member 12 from the beginning, and since the developer layer 24 does not contain the magnetic particles, or if any, it contains only a small amount to compensate the unavoidably lost magnetic particles, the state of the magnetic brush formed in the base layer 16 is maintained constant over a long run of the device. In this sense, the magnetic particles within the magnetic particle layer is a part of the developing or thin layer forming apparatus, rather than a developer agent or a part of a developer agent.

In this embodiment, the developer carrying member 12 is used which is an aluminum sleeve of 20 mm diameter having a surface treated by irregular sandblasting with an ALUNDUM abrasive. The surface may be treated by regular blasting with glass beads, by etching, by extrusion, by sand-paper or by anodic oxidation. The magnetic field generating means 13 has two magnetic poles, that is, N pole and S pole disposed as shown in FIG. 3, with the N pole positioned at i=90 degrees.

The magnet shown in FIG. 3 provides the maximum surface flux density of approx. 500 Gauss. It is preferable that the maximum value is increased, if the flowability of the used developer is slightly low. It has been observed with human eyes that when the surface flux density is approx. 800 Gauss, the circulation in the direction of the arrow c in FIG. 5 is doubled.

The magnetic blade 23 is a steel plate of 1.2 mm thickness which is chemically nickel-plated. The steel plate is preferably of SPC steel plate, Si steel plate or permalloy. The magnetic blade 23 which is of one of those magnetic materials which may be so magnetized that the magnetic field is strengthened in the tangential direction. In FIG. 5, the angle $\theta=35$ degrees, the angle $\phi=85$ degrees, the clearance between the magnetic blade 23 and the surface of the sleeve 12 is 250 microns. The angle $\phi$ may be 90 degrees, that is, the magnetic blade 23 extends along the tangent of the sleeve surface, but in that case, the magnetic blade 23 can unintentionally conducted to the sleeve surface if the manufacturing precision is not satisfactorily high. This tendency is remarkable when the angle $\phi$ is larger than 90 degrees, so that this range is not preferable from the standpoint of the magnetic particle confinement. A sealing member 21 in the form of polyethyleneterephthalate sheet of 0.2 mm thickness is mounted as shown in FIG. 5. In place of the sealing member 21, a magnetic sealing member of a magnetic material may be used for forming a magnetic field with the magnetic pole 22 to prevent the leakage of the magnetic particles.

As for the magnetic particles, iron particles (maximum magnetization 190 emu/g) of 100–80 microns (150/200 mesh) are used. For the non-magnetic developer, blue toner is used. The toner particles of average particle size have 10 microns and include 100 parts of styrene-butadiene copolymer resin and 5 parts of copper phthalocyanine pigment with 0.6% of colloidal silica. When the apparatus according to this embodiment was operated under the foregoing conditions, the sleeve 12 was coated with the toner layer of 50–100 microns thickness. The triboelectric charging on the toner in the coated layer was measured by a blow-off method, and the result was $+10\mu c/g$.

The thin developer layer forming apparatus according to this embodiment was then actually incorporated into a PC-10 copying machine (available from Canon Kabushiki Kaisha, Japan), and operated with the bias voltage 25 of 1600 Hz, and peak-to-peak voltage of 1300

V of AC superposed with DC of −300 V. The sleeve 12 was set to the photosensitive member 11 of organic photoconductor with the clearance therebetween of 250 microns, then, a good blue color image was obtained.

In this embodiment, the non-magnetic developer is used, but magnetic developer may also be usable, if the magnetism thereof is very weak as compared with that of the magnetic particle, or if the particle size of the developer is smaller than that of the magnetic particle, and if the developer is triboelectrically chargeable. Depending on the magnetic properties of the magnetic particle used, the stationary layer 20 of the magnetic particles does not reach to the position of the magnetic blade 23 to leave a region not containing the magnetic particles between the magnetic blade 23 and the stationary layer 20. If this occurs, the toner particles can undesirably be leaked through the clearance between the magnetic blade 23 and the sleeve 12. To avoid this, the magnetic particles are preferably such that they form a sufficiently high brush.

Figure 6:
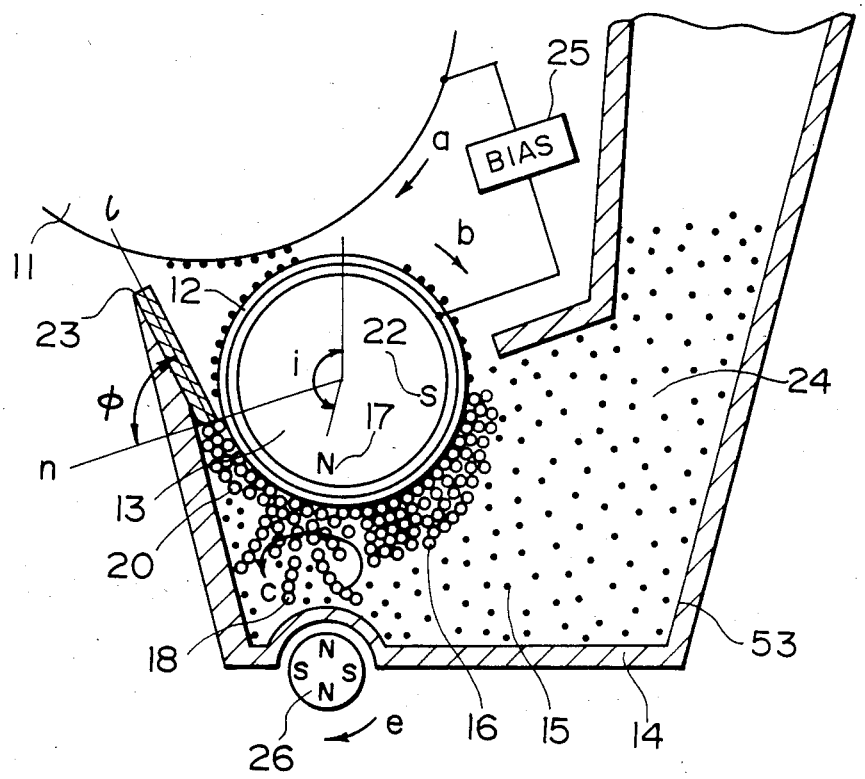
FIGS. 6 and 7 are cross-sectional view of the apparatus according to another embodiment of the present invention.

FIG. 6 shows another embodiment of the present invention. Since this embodiment is similar to the embodiment described with FIG. 5, except for the portions which will be described, the detailed description of the similar parts is omitted for the sake of simplicity by assigning the same reference numerals to the elements having the corresponding functions. In FIG. 6, the rotations of the photosensitive member 11 and the sleeve 12 are such that they move in the opposite directions at the position where they are close. The N pole 17 of the magnetic 13 is disposed upstream thereof with respect to movement of the sleeve 12, at the position of i=150 degrees. When the apparatus of this embodiment was actually operated with the magnetic particles and toner particles which were the same as used with FIG. 5 embodiment, the confinement performance was good, but the circulation performance was not good as shown in Table 1. To obviate this problem, a magnet 26 is provided outside the developer supply container 14 and rotated in the direction shown by an arrow e. When the apparatus with this auxiliary magnet 26 was actually operated, a good circulation performance was obtained, and the coating layer provided was comparable to that of FIG. 5 embodiment. The angle $\phi$ formed between the magnetic blade 23 and the normal line was 60 degrees, but the magnetic particles were confined when the angle $\phi$ was 45–90 degrees.

Table 2 below shows the results of experiments for the circulation performance when the magnet 26 is used, wherein "G" means a good performance, "F" means a fair performance, and "B" means a bad performance.

TABLE 2

| Angle i (degrees) | Circulation performance with magnet 26 |
|---|---|
| 40 | G |
| 50 | G |
| 60 | G |
| 70 | G |
| 80 | G |
| 90 | G |
| 100 | G |
| 110 | G |
| 120 | G |
| 130 | G |
| 140 | G |
| 150 | G |
| 160 | F |

TABLE 2-continued

| Angle i (degrees) | Circulation performance with magnet 26 |
|---|---|
| 170 | B |

As will be understood from Tables 1 and 2, the circulation performance was improved by the provision of the magnet 26. In place of the magnet 26, a stirring rod may be provided in the developer supply container 14. The stirring rod is rotated to improve circulation performance. More preferably, the stirring rod is of magnetic material, so that the magnetic field provided by the N pole 17 is intentionally disturbed, with the result that a sufficient circulation performance can be provided.

Figure 7:
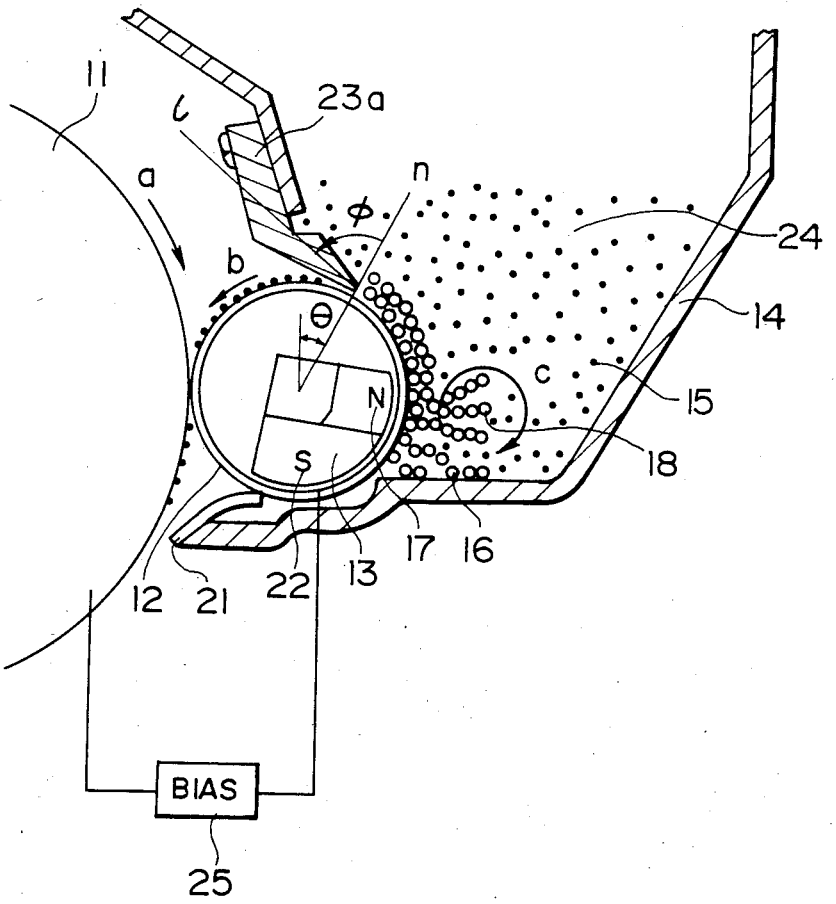

FIG. 7 shows a further embodiment of the present invention. Since this embodiment is similar to the embodiment described with FIG. 5, except for the portions which will be described, the detailed description of the similar parts is omitted for the sake of simplicity by assigning the same reference numerals to the elements having the corresponding function. The magnetic blade 23 of FIG. 5 embodiment has been made from a metal sheet, so that it can distort or warp in its longitudinal direction, which will influence the precision. In view of this, in the embodiment of FIG. 7, the magnetic blade **23*a* is made of a profiled member produced by drawing a steel material. When this is used, the clearance between the blade 23*a* and the sleeve 12 was made uniform over the entire length with high precision. In this case, the blade inclination angle $\phi$ is measured between the normal line n and the center line 1 of the magnetic blade 23*a*, as shown in FIG. 7**.

In the embodiments shown in FIGS. 5–7, the electric potential of the magnetic blade 23 or **23*a* is preferably kept at the same potential of the sleeve 12. It is possible that the bias power source 25 supplies electricity to the magnetic blade 23 or 23*a*, and applies a bias voltage to the sleeve 12** through the magnetic particles.

According to the present invention, the better confinement performance for the magnetic particles and the stable and uniform circulation performance thereof, are obtained, in a thin developer layer forming apparatus of a simple structure used with magnetic particles. As a result, a uniformly and satisfactorily charged toner particle layer of a uniform thickness can be formed with the use of a relatively smaller amount of magnetic particles. Also, when a latent image is developed with this thin developer layer, a stabilized developed image is provided. In addition, since the magnetic particle confining member is inclined toward downstream with respect to the direction of the movement of the developer carrying member, the magnetic field in the tangential direction on the developer carrying member is stronger than that in the normal direction, so that the blocking of the developer at the magnetic particle confining member, fusion of the developer and the leakage of the magnetic particles are prevented. For these reasons, the present invention is applicable to a developing apparatus used with pressure-fixing type toner.

Figure 8:
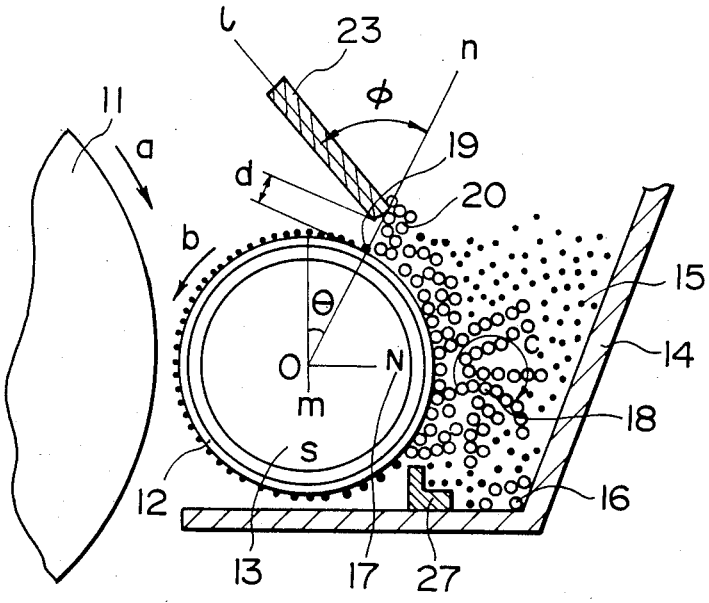
FIG. 8 is a cross-sectional view of a thin developer layer forming apparatus according to a further embodiment of the present invention.

FIG. 8 shows a further embodiment of the present invention wherein a magnetic member is provided at the bottom of the thin developer layer forming apparatus to prevent the leakage of the developer particles or magnetic particles. Since this embodiment is similar to the embodiment described with FIG. 5, except for the portions which will be described, the detailed description of the similar parts is omitted for the sake of similicity by assigning the same reference numerals to the elements having the corresponding functions. As shown in FIG. 8, there is provided a magnetic member 27 having "L" cross-section on the bottom of the container 14. One of the lateral edges of the magnetic member 27 is directed to the magnetic pole 17 of the magnet 13. Between the magnetic pole 17 and the magnetic member 27, a magnetic brush of the magnetic particles 16 is formed by this magnetic field. The magnetic brush is effective to prevent the developer particles or magnetic particles 16 from leaking beyond the magnetic member 27 toward the upstream with respect to the rotation of the sleeve 12. In the region, along the surface of the sleeve 12 between the magnetic member 27 and the magnetic blade 23, there is only one magnetic pole (N) 17.

Figure 9:
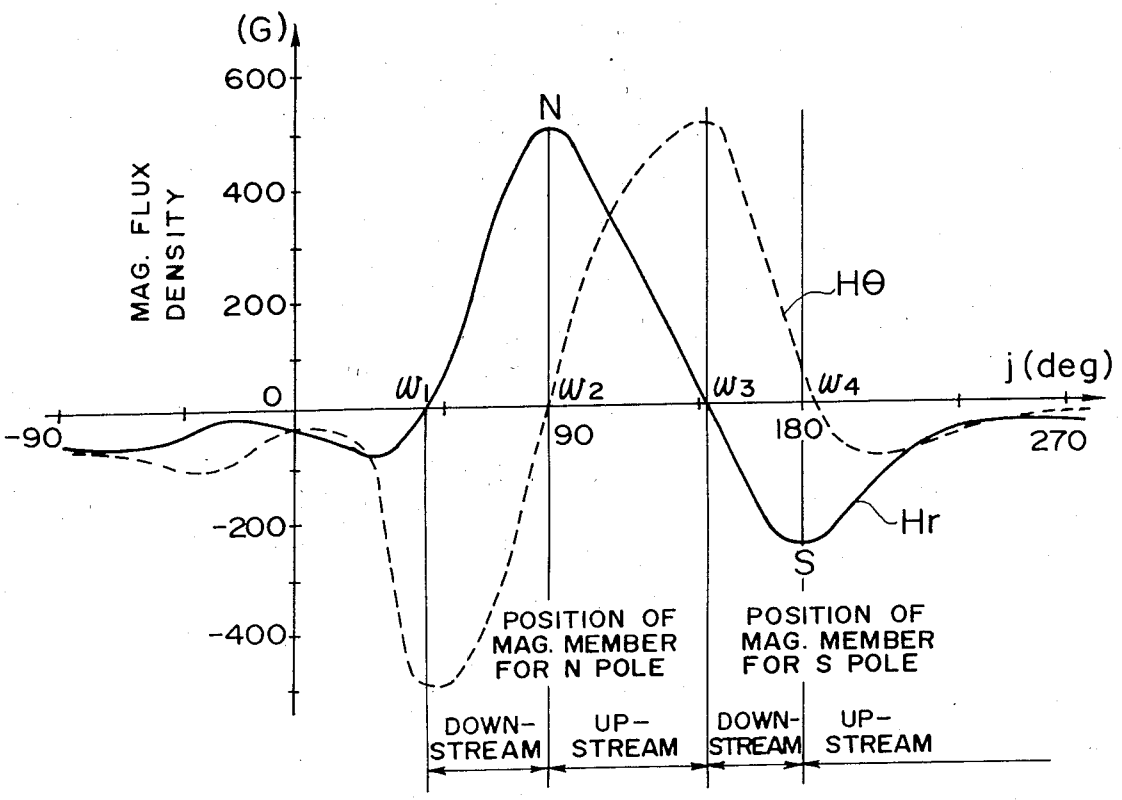
FIG. 9 shows a magnetic force distribution.

The position of the magnetic member 27 will be described in detail. FIG. 9 is a graph showing the magnetic flux density distribution on the surface of the sleeve 12 containing the magnet 13 as shown in FIG. 8. In FIG. 9, the solid line is the magnetic flux density distribution in the normal direction $H\theta$ on the surface of the sleeve 12, while the broken line is that in the tangential direction Hr, which have been measured by a Gauss meter. It is understood from FIG. 9 that the normal component and the tangential component are in the relationship of orthogonal functions, in the actual measured values. The angle j is the angle measured from the vertical line m passing through the center O of the sleeve 12 in the clockwise direction (+) in FIG. 8.

Figure 10:
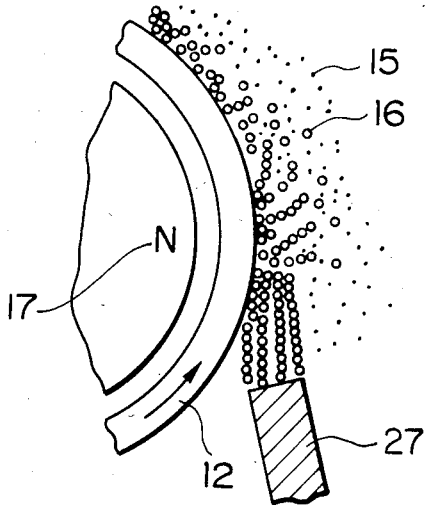
FIG. 10 is a cross-sectional view of a part of the apparatus according to the embodiment of the present invention.

The magnitude and the direction of the magnetic force on a certain point of the sleeve 12, is the resultant force of the normal component and the tangential component shown in FIG. 9. If the magnetic member 27 is extended in the direction of the resultant magnetic field, the formation of the magnetic brush between the magnetic pole and the magnetic member 27 is assured (FIG. 10). The formation of the magnetic brush serves to prevent the magnetic particles and developer particles from leaking out of the container 14 at its bottom.

According to this embodiment of the present invention, the magnetic blade 23 and the magnetic member 27 are both extended along the directions of the respective magnetic force, and the apparatus of FIG. 8 is so constructed. Here, the magnetic blade 23, in order to confine the magnetic particles, is provided at a position downstream of the magnetic pole N with respect to the movement direction of the sleeve 12 and inclined downstream, whereas the magnetic member 27 is provided at a position upstream thereof and inclined upstream in order to prevent the developer particles 15 from being scraped from the surface of the sleeve 12. To confine the magnetic particles by the magnetic blade 23, the magnetic blade 23 is necessarily positioned between w1–w2 range in FIG. 9. And, it is preferable that the magnetic member 27 is between w2–w3 or between w4–w1. From the standpoint of the circulation and the confinement of the magnetic particles 16, it is preferable that the magnetic blade 23 and the magnetic member 27 are at the same side of the vertical line m passing though the center 0 of the sleeve 12 (right-side in FIG. 8). Therefore, if the arrangement is such that the magnetic pole cooperating with the magnetic blade and that cooperating with the magnetic member, are different (for example, if the magnetic member 27 is located at a position where the magnetic flux density distribution is as shown between w4 and w1 in FIG. 9), two or more magnetic poles must be located within a half circle (180 degrees). This necessarily requires a larger diameter of the magnet, resulting in a bulky device.

If, on the other hand, the arrangement is such that the same magnetic pole is cooperative with the magnetic blade 23 and also with the magnetic member 27, that is, the magnetic pole does not change between the magnetic blade 23 and the magnetic member 27, in other words, there is only one magnetic pole therebetween, a very small size apparatus can be achieved. Therefore, the magnetic member 27 is disposed between w2–w3 in FIG. 9, and there is one magnetic pole in the region between the magnetic blade 23 and the magnetic member.

Figure 11:
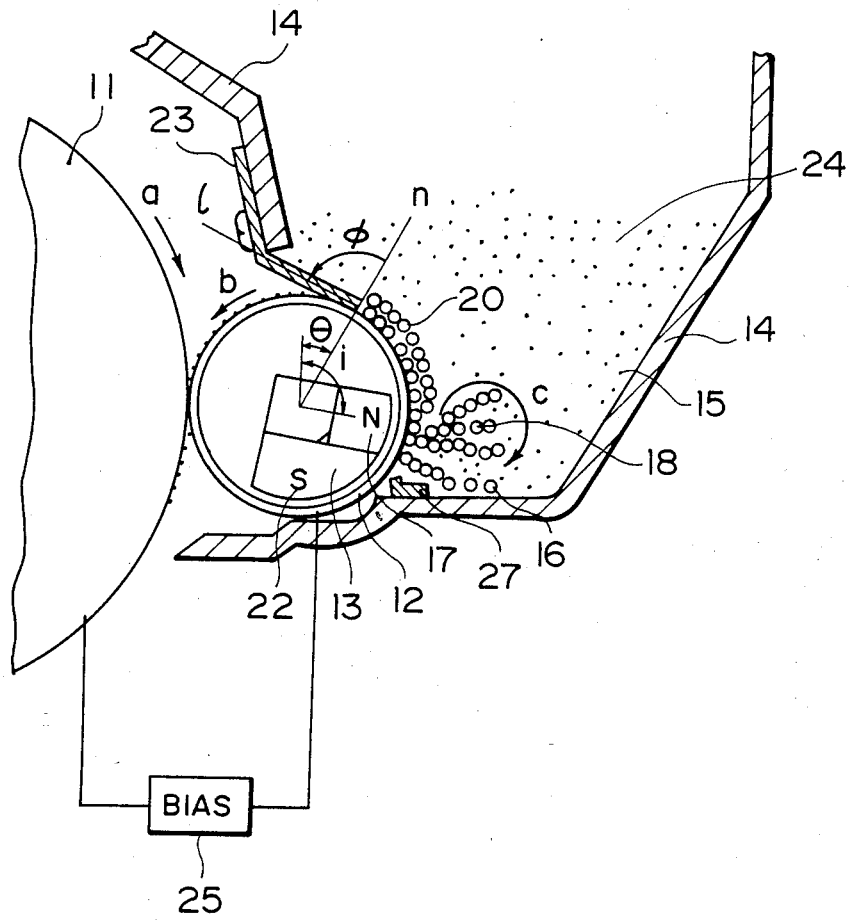
FIG. 11 is a cross-sectional view of a developing apparatus used with the thin developer layer forming apparatus according to the embodiment of the present invention.

FIG. 11 shows the thin developer layer forming apparatus according to the present invention, wherein at the bottom of the developer supply container 14, there is a magnetic member 27 to prevent the developer and the magnetic particles from leaking out.

In this embodiment, the developer carrying member 12 is used which is an aluminum sleeve of 20 mm diameter having a surface treated by irregular sandblasting with an ALUNDUM abrasive. The surface may be treated by regular blasting with glass beads, by etching, by extrusion, by sand-paper or by anodic oxidation. The magnetic field generating means 13 has two magnetic poles, that is, N pole and S pole disposed as shown in FIG. 3, with the N pole positioned at i=95 degrees.

The magnet shown in FIG. 11 provides the maximum surface flux density of approx. 500 Gauss. It is preferable that the maximum value is increased, if the flowability of the used developer is slightly low. It has been observed with human eyes that when the surface flux density is approx. 800 Gauss, the circulation in the direction of the arrow c in FIG. 5 is doubled.

The magnetic blade 23 is a steel plate of 1.2 mm thickness which is chemically nickel-plated. The steel plate is preferably of SPC steel plate, Si steel plate or permalloy. The magnetic blade 23 which is of one of those magnetic material may be so magnetized that the magnetic field is strengthened in the tangential direction. In FIG. 11, the angle $\theta=35$ degrees, the angle $\phi=85$ degrees, the clearance between the magnetic blade 23 and the surface of the sleeve 12 is 250 microns. The angle $\phi$ may be 90 degrees, that is, the magnetic blade 23 extends along the tangent of the sleeve surface, but in that case, the magnetic blade 23 can unintentionally conducted to the sleeve surface if the manufacturing precision is not satisfactorily high. This tendency is remarkable when the angle $\phi$ is larger than 90 degrees, so that this range is not preferable from the standpoint of the magnetic particle confinement.

The magnetic member 27 is made of a steel plate of 1 mm thickness and is inclined by 30 degrees, with respect to the normal line, toward upstream with respect to the rotation of the sleeve. The magnetic member 27 is spaced from the surface of the sleeve 12 by 1.5 mm it has been experimentally confirmed that there is no leakage of the magnetic particles or the developer particles. Additionally, the developer on the sleeve 12 is not scraped.

As for the magnetic particles, iron particles (maximum magnetization 190 emu/g) of 100–80 microns (150/200 mesh) are used. For the non-magnetic developer, blue toner is used. The toner particle of average particles size have an 10 microns and include 100 parts of styrene-butadiene copolymer resin and 5 parts of copper phthalocyanine pigment with 0.6% of colloidal silica. When the apparatus according to this embodiment was operated under the foregoing conditions, the sleeve 12 was coated with the toner layer of 50–100 microns thickness. The triboelectric charging on the toner in the coated layer was measured by a blow-off method, and the result was +10 μc/g.

The thin developer layer forming apparatus according to this embodiment was then actually incorporated into a PC-10 copying machine (available from Canon Kabushiki Kaisha, Japan), and operated with the bias voltage 25 of 1600 Hz, and peak-to-peak voltage of 1300 V of AC superposed with DC of −300 V. The sleeve 12 was set to the photosensitive member 11 of organic photoconductor with the clearance therebetween of 250 microns, then, a good blue color image was obtained.

In this embodiment, the non-magnetic developer is used, but magnetic developer may also be usable, if the magnetism thereof is very weak as compared with that of the magnetic particle, or if the particle size of the developer is smaller than that of the magnetic particle, and if the developer is triboelectrically chargeable.

According to the present invention, the better confinement performance for the magnetic particles and the stable and uniform circulation performance thereof, are obtained, in a thin developer layer forming apparatus of a simple structure used with magnetic particles. As a result, a uniformly and satisfactorily charged toner particle layer of a uniform thickness can be formed with the use of relatively smaller amount of magnetic particles. In addition, since the magnetic particle confining member is inclined toward downstream with respect to the direction of the movement of the developer carrying member, the magnetic field in the tangential direction on the developer carrying member is stronger than that in the normal direction, so that the blocking of the developer at the magnetic particle confining member, fusion of the developer and the leakage of the magnetic particles are prevented. For these reasons, the present invention is applicable to a developing apparatus used with pressure-fixing toner.

Furthermore, the magnetic sealing member can prevent the developer particles or magnetic particles from leaking out of the thin developer layer forming apparatus at its bottom, so that the developer does not leak or scatter even when it is vibrated by the mechanism therearound, or when it hits another member, or it is violently handled. Additionally, only one magnetic pole is placed between the magnetic particle confining member and the magnetic sealing member, whereby a small diameter magnetic is usable, so that a compact thin developer layer forming apparatus can be achieved.

While the invention has been described with reference to the structures disclosed herein, it is not confined to the details set forth and this application is intended to cover such modifications or changes as may come within the purposes of the improvements or the scope of the following claims.

What is claimed is:

1. A thin developer layer forming apparatus, comprising:

a developer supply container, having an opening, for containing a developer and magnetic particles;

an endlessly movable developer carrying member for carrying the developer and which is movable between the inside of said developer supply container and the outside of said developer supply container through the opening;

a magnetic-particle confining member of magnetic material and spaced from an outer surface of said developer carrying member to define a gap therebetween; and means for generating a fixed magnetic field, having magnetic pole means disposed inside of said carrying member and upstream of said confining member with respect to the movement direction of said developer carrying member;

wherein said confining member is inclined toward downstream with respect to the movement direction of said developer carrying member to confine the magnetic particles within said developer supply container and apply only the developer on said developer carrying member.

2. An apparatus according to claim 1, wherein said confining member is inclined, at an angle of 45 degrees—90 degrees with respect to a line which is normal to the outer surface of said developer carrying member and which passes through a tip of said confining member, toward downstream with respect to the movement direction of said developer carrying member.

3. An apparatus according to claim 1, wherein said confining member extends substantially along a direction of a magnetic field formed by said magnetic pole means.

4. An apparatus according to claim 2, wherein said confining member extends substantially along a direction of a magnetic field formed by said magnetic pole means.

5. An apparatus according to claim 1, wherein said developer carrying member is a non-magnetic sleeve, and said magnetic pole means is disposed 20–120 degrees upstream, from a vertical line which passes through the center of said sleeve, with respect to the movement direction of said sleeve.

6. An apparatus according to claim 5, wherein said confining member is disposed in a range which satisfies, $$H\theta(\theta) \geqq Hr(\theta)$$

where $Hr(\theta)$ is a normal component of the magnetic field, and $H\theta(\theta)$ is a tangential component of the same.

7. An apparatus according to claim 1, wherein said confining member is spaced from said developer carrying member by a clearance of 100–1000 microns.

8. An apparatus according to claim 7, wherein the magnetic particles have a particle size of 30–200 microns.

9. An apparatus according to claim 1, further comprising a magnetic member, disposed adjacent to a position of said developer container where said developer carrying member moves toward the inside of said developer container.

10. An apparatus according to claim 9, wherein said magnetic field generating means has one magnetic pole between said confining member and said magnetic member.

11. An apparatus according to claim 1, wherein said developer is a non-magnetic toner.

12. An apparatus according to claim 1, wherein said developer carrying member is opposed to an image bearing member bearing an electrostatic latent image thereon to form a developing station where the developer in the form of a thin layer is applied to the image bearing member to develop the electrostatic latent image thereon.

13. An apparatus according to claim 1, wherein said magnetic particle confining member includes a blade of magnetic material, and said carrying member includes a sleeve of non-magnetic material, and wherein said magnetic blade has an end forming said gap with said sleeve and extends codirectionally with a magnetic field formed at the end thereof.

14. A thin developer layer forming apparatus, comprising:

a developer supply container, having an opening, for containing a non-magnetic developer and magnetic particles;

an endlessly movable developer carrying sleeve for carrying the developer, which is movable between an inside of said developer supply container and an outside of said developer supply container through the opening;

a confining member spaced apart from an outer surface of said developer carrying sleeve to form a gap therebetween at a position $\theta$ degrees away from a vertical line m passing through the center of said sleeve and upstream with respect to the rotation direction of said sleeve;

means for generating a fixed magnetic field having magnetic pole means disposed inside of said carrying member;

wherein a normal line n to the outer surface of said sleeve at a position where said gap is formed forms the angle $\theta$ with said vertical line m, wherein a magnetic force $R\theta$ in a tangential direction on the sleeve at the gap is larger than a magnetic force Rr in the normal direction n thereat, and wherein the coefficient of friction f and said angle $\theta$ satisfy $\theta \geqq \mathrm{Tan}^{-1}f$ so as to supply substantially only non-magnetic developer on said sleeve while the magnetic particles are confined by the confining member.

15. An apparatus according to claim 14, wherein said confining member includes a magnetic member, and said confining member has an end adjacent to said magnetic pole means, and wherein said confining member extends from the end toward the downstream with respect to the rotation of said developer carrying sleeve away from said developer carrying sleeve.

16. An apparatus according to claim 14, wherein said developer carrying member is opposed to an image bearing member bearing an electrostatic latent image thereon to form a developing station where the developer in the form of a thin layer is applied to the image bearing member to develop the electrostatic latent image thereon.

17. A thin developer layer forming apparatus, comprising:

a developer supply container, having an opening, for containing a developer and magnetic particles;

an endlessly movable developer carrying member for carrying the developer, which is movable between an inside of said developer supply container and an outside of said developer supply container through the opening;

a magnetic-particle confining member of magnetic material and spaced from an outer surface of said developer carrying member to define a gap therebetween;

a magnetic member, disposed adjacent to a position of said developer container where said developer carrying member moves toward the inside of said developer container;

means for generating a fixed magnetic field, having one magnetic pole between said confining member and said magnetic member, wherein said one magnetic pole cooperates with said confining member to confine the magnetic particles at said gap, and also cooperates with said magnetic member to confine magnetic particles at said position.

18. An apparatus according to claim 17, wherein said developer carrying member is opposed to an image bearing member bearing an electrostatic latent image thereon to form a developing station where the developer in the form of a thin layer is applied to the image bearing member to develop the electrostatic latent image thereon.

19. An apparatus according to claim 17, wherein said confining member has an end adjacent to said one magnetic pole and wherein said confining member extends from the end toward the downstream with respect to the rotation direction of said developer carrying sleeve away from said developer carrying sleeve.

* * * * *

UNITED STATES PATENT AND TRADEMARK OFFICE

CERTIFICATE OF CORRECTION

PATENT NO. : 4,583,490

DATED : April 22, 1986

INVENTOR(S) : FUMITAKA KAN, ET AL.

It is certified that error appears in the above-identified patent and that said Letters Patent is hereby corrected as shown below:

Column 1, line 9, change "developer" to --develop--;

line 17, change "necessiated" to --necessitated--; and line 24, change "nonmagnetic" to --non-magnetic--.

Column 2, line 48, change "view to" to --views--.

Column 3, line 38, change "the of the sleeve" to --the sleeve-- and change "because balance" to --because of the balance--;

line 64, change "nonmagnetic" to --non-magnetic--; and line 66, change "return" to --returns--.

UNITED STATES PATENT AND TRADEMARK OFFICE

CERTIFICATE OF CORRECTION

PATENT NO. : 4,583,490

DATED : April 22, 1986

INVENTOR(S) : FUMITAKA KAN, ET AL.

It is certified that error appears in the above-identified patent and that said Letters Patent is hereby corrected as shown below:

Column 6, line 34, change "are" to --is--; and line 54, change "above mentioned" to --above-mentioned--.

Column 7, line 26, change "preferable" to --preferably--.

Column 8, line 55, change "nonmagnetic" to --non-magnetic--.

Column 9, line 18, change "layer" to --layers--.

Column 10, line 9, change "is" to --are--;

lines 39-40, change "unintentionally conducted" to --unintentionally be conducted--; and line 54, change "of average" to --have average--.

UNITED STATES PATENT AND TRADEMARK OFFICE

CERTIFICATE OF CORRECTION

PATENT NO. : 4,583,490

DATED : April 22, 1986

INVENTOR(S) : FUMITAKA KAN, ET AL.

It is certified that error appears in the above-identified patent and that said Letters Patent is hereby corrected as shown below:

Column 11, line 32, change "magnetic" to --magnet--.

Column 14, lines 47-48, change "unintentionally conducted" to --unintentionally be conducted--; and lines 65-66, change "particle of average particles size have an 10" to --particles have an average size of 10--.

Column 15, line 51, change "magnetic" to --magnet--.

Signed and Sealed this

Thirteenth Day of January, 1987

*Attest:*

*Attesting Officer*

DONALD J. QUIGG

*Commissioner of Patents and Trademarks*